US010696365B2

(12) United States Patent
Dabbous et al.

(10) Patent No.: US 10,696,365 B2
(45) Date of Patent: Jun. 30, 2020

(54) OIL FIELD WELL DOWNHOLE DRONE

(71) Applicant: Saudi Arabian Oil Company, Dhahran (SA)

(72) Inventors: Mohammed Dabbous, Qatif (SA); David Lewis, Najmah (SA)

(73) Assignee: Saudi Arabian Oil Company, Dhahran (SA)

( * ) Notice: Subject to any disclaimer, the term of this patent is extended or adjusted under 35 U.S.C. 154(b) by 255 days.

(21) Appl. No.: 15/960,760

(22) Filed: Apr. 24, 2018

(65) Prior Publication Data

US 2019/0322342 A1 Oct. 24, 2019

(51) Int. Cl.

| | |
|---|---|
| ***E21B 47/06*** | (2012.01) |
| ***E21B 47/09*** | (2012.01) |
| ***E21B 47/10*** | (2012.01) |
| ***E21B 47/12*** | (2012.01) |
| ***B63G 8/00*** | (2006.01) |
| ***E21B 47/07*** | (2012.01) |
| ***E21B 47/095*** | (2012.01) |

(52) U.S. Cl.

CPC ..... *B63G 8/001* (2013.01); *E21B 47/07* (2020.05); *E21B 47/095* (2020.05); *E21B 47/10* (2013.01); *E21B 47/12* (2013.01); *B63G 2008/004* (2013.01); *B63G 2008/005* (2013.01)

(58) Field of Classification Search

CPC ..... E21B 47/065; E21B 47/091; E21B 47/10; E21B 47/12; E21B 41/04; B63G 2008/004; B63G 2008/005; B63G 8/001; B63G 2008/002

See application file for complete search history.

(56) References Cited

U.S. PATENT DOCUMENTS

| | | | |
|---|---|---|---|
| 4,721,055 | A | 1/1988 | Pado |
| 6,349,665 | B1 | 2/2002 | Taylor, Jr. |
| 7,353,768 | B1 | 4/2008 | Jones et al. |
| 9,321,529 | B1 | 4/2016 | Jones et al. |
| 9,457,900 | B1 | 10/2016 | Jones et al. |
| 9,476,274 | B2 | 10/2016 | Edmonstone et al. |
| 10,104,289 | B2 * | 10/2018 | Enriquez ..... H04N 5/23238 |

(Continued)

FOREIGN PATENT DOCUMENTS

| | | |
|---|---|---|
| WO | 2014185791 A1 | 11/2014 |
| WO | 2016193666 A2 | 12/2016 |

OTHER PUBLICATIONS

International Search Report and Written Opinion for related PCT application PCT/US2019/028722 dated Aug. 28, 2019.

*Primary Examiner* — Daniel P Stephenson

(74) *Attorney, Agent, or Firm* — Bracewell LLP; Constance G. Rhebergen; Brian H. Tompkins

(57) ABSTRACT

Embodiments of the disclosure include an unmanned submersible vehicle for use in surveying subsurface wells. The unmanned submersible vehicle may be inserted into a well and may acquire measurements while traversing the well and at various measurement locations in the well. The unmanned submersible vehicle may include propulsion units having propellers and an arm pivotably attached to a body of the vehicle. The propellers of the propulsion units may be used to measure flow velocity of a fluid when the unmanned submersible vehicle is in a well. The unmanned submersible vehicle may include a measurement unit for measuring temperature, pressure, and gradient.

23 Claims, 4 Drawing Sheets

(56) References Cited

U.S. PATENT DOCUMENTS

| | | | | |
|---|---|---|---|---|
| 2012/0160011 | A1 | 6/2012 | Whittaker et al. | |
| 2015/0183498 | A1 | 7/2015 | Wardle | |
| 2015/0192488 | A1 | 7/2015 | Xu et al. | |
| 2016/0031275 | A1* | 2/2016 | Monroe | B60F 3/0007 244/2 |
| 2016/0129979 | A1* | 5/2016 | Rossano | B63G 8/001 114/333 |
| 2016/0320769 | A1 | 11/2016 | Deffenbaugh et al. | |
| 2016/0341587 | A1 | 11/2016 | Huang et al. | |
| 2016/0376000 | A1 | 12/2016 | Kohstall | |
| 2017/0036746 | A1 | 2/2017 | MacCready et al. | |
| 2017/0145777 | A1 | 5/2017 | Vasques et al. | |
| 2017/0190421 | A1 | 7/2017 | Diez-Garias et al. | |
| 2017/0197714 | A1* | 7/2017 | Golden | B64C 39/024 |
| 2018/0027772 | A1* | 2/2018 | Gordon | A01K 15/023 |
| 2018/0029522 | A1* | 2/2018 | Gordon | B60Q 1/0017 |
| 2018/0063429 | A1 | 3/2018 | Enriquez et al. | |
| 2019/0322342 | A1* | 10/2019 | Dabbous | E21B 41/04 |

* cited by examiner

OIL FIELD WELL DOWNHOLE DRONE

BACKGROUND

Field of the Disclosure

The present disclosure generally relates to the surveying of subsurface wells used to extract hydrocarbons such as oil and gas. More specifically, embodiments of the disclosure relate to a downhole submersible vehicle for the in situ measurement of various fluids and properties of subsurface wells.

Description of the Related Art

Subsurface wells may be drilled into the earth to access fluids stored in geographic formations having hydrocarbons. These geographic formations may contain or be referred to as a "reservoir." Information about fluids in and properties of a well is important for properly characterizing the reservoir and conducting optimal drilling and production operations to efficiently extract hydrocarbons. Wells may have combinations of vertical, deviated, and horizontal sections that make surveying the wells challenging and time-consuming. For example, a well may be surveyed via the use of a mechanical conveyance from the surface, such as coiled tubing (that is, flexible integrated well tubulars). However, the use of coiled tubing is subject to hole size limitations and, more significantly, may become locked up to well geometry. Other approaches for well surveying may include wireline conveyed well tractors that are limited by hole irregularities (for example, the increase or decrease of hole sizes affecting tractor arms) and well geometry.

SUMMARY

Existing technologies for surveying a well, such as production logging tools conveyed into the wellbore by coiled tubing, wireline (either slick line or electric line), or a well tractor in combination with wireline or with coiled tubing, may have limited wellbore access due to numerous factors, such as the length of the wellbore, the trajectory and inclination of the wellbore and the wellbore size (for example, inner diameter or hole size). These factors, and additional in situ environmental factors, may limit and restrict access to and surveying of the entire wellbore via existing technologies.

Embodiments of the disclosure include an unmanned submersible vehicle (sometimes referred to as a "drone") for use in surveying subsurface wells. Advantageously, the unmanned submersible vehicle is capable of accessing all sections of wells regardless of orientation (that is, vertical, deviated, or horizontal) by use of onboard propulsion units and power unit, thus eliminating the use of coiled tubing, a wireline, or associated equipment extending from the surface. Moreover, the unmanned submersible vehicle may be propelled through the well without direct contact with the borehole wall. The unmanned submersible vehicle may also be capable of recharging a battery of the power unit to extend the duration of data collection (that is, acquisition of measurements) when the unmanned submersible vehicle is submersed in a well.

In one embodiment, an unmanned submersible vehicle is provided that includes a body and a plurality of propulsion units, each of the plurality of propulsion units has a propeller and an arm pivotably coupled to the body. The unmanned submersible vehicle further includes a measurement unit, a control unit having a processor and a memory. Each of the plurality of propulsion units is configured to measure a flow velocity of a fluid in the well when the unmanned submersible vehicle is stationary. In some embodiments, the measurement unit includes a distributed temperature sensing (DTS) system. In some embodiments, the measurement unit includes a distributed acoustic sensing (DAS) system. In some embodiments, the measurement unit includes a digital temperature sonde, a digital pressure sonde, or a combination thereof. In some embodiments, the unmanned submersible vehicle includes a location unit having a receiver for a satellite-based navigation system. In some embodiments, the unmanned submersible vehicle includes a power unit that includes a rechargeable battery. In some embodiments, at least one of the plurality of propulsion units is coupled to a generator, such that the generator converts rotation of a respective propeller into electrical energy to recharge the rechargeable battery. In some embodiments, the unmanned submersible vehicle includes a data storage unit that includes a non-volatile memory. In some embodiments, the unmanned submersible vehicle includes a microcontroller unit having a microcontroller and a memory. In some embodiments, the unmanned submersible vehicle includes a camera coupled to the body.

In another embodiment, a method of surveying a well is provided. The method includes positioning an unmanned submersible vehicle at a measurement location in the well. The unmanned submersible vehicle includes a body and a plurality of propulsion units, each of the plurality of propulsion units has a propeller and an arm pivotably coupled to the body. The unmanned submersible vehicle further includes a measurement unit, a control unit having a processor and a memory. The method further includes measuring, at the measurement location, a flow velocity of a fluid flowing in the well using at least two of the propulsion units. In some embodiments, the method includes measuring, at the measurement location, a temperature and a pressure in the well. In some embodiments, the measurement location is a first measurement location and the method includes moving the unmanned submersible vehicle to second measurement location. In some embodiments, the method includes measuring, during the moving, a temperature and a pressure in the well. In some embodiments, the method includes measuring, at the second measurement location, a flow velocity of a fluid flowing in the well using at least two of the propulsion units. In some embodiments, the unmanned submersible vehicle includes a power unit that includes a rechargeable battery. In some embodiments, the method includes charging the rechargeable battery by converting rotation of a respective propeller of one of the plurality of propulsion units into electrical energy. In some embodiments, measuring, at the measurement location, a flow velocity of a fluid flowing in the well using at least two of the propulsion units includes pivoting the at least two of the propulsion units such that the respective propellers of the at least two propulsion units rotate in response to the flow of the fluid. In some embodiments, the unmanned submersible vehicle includes a data storage unit that includes a non-volatile memory. In some embodiments, the method includes storing the flow velocity measurement in the non-volatile memory.

In another embodiment, a method of surveying a well is provided. The method includes inserting an unmanned submersible vehicle into a wellbore of the well, the unmanned submersible vehicle. The unmanned submersible vehicle includes a plurality of propulsion units, each of the plurality of propulsion units having a propeller and an arm pivotably coupled to the body. The method further includes moving the unmanned submersible vehicle to a measurement location in the well and measuring, at the measurement location, a flow velocity of a fluid flowing in the well using at least two of the propulsion units. In some embodiments, the measurement location is at a production section of the well. In some embodiments, measuring, at the measurement location, a flow velocity of a fluid flowing in the well using at least two of the propulsion units includes pivoting the at least two of the propulsion units such that the respective propellers of the at least two propulsion units rotate in response to the flow of the fluid.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Figure 1:
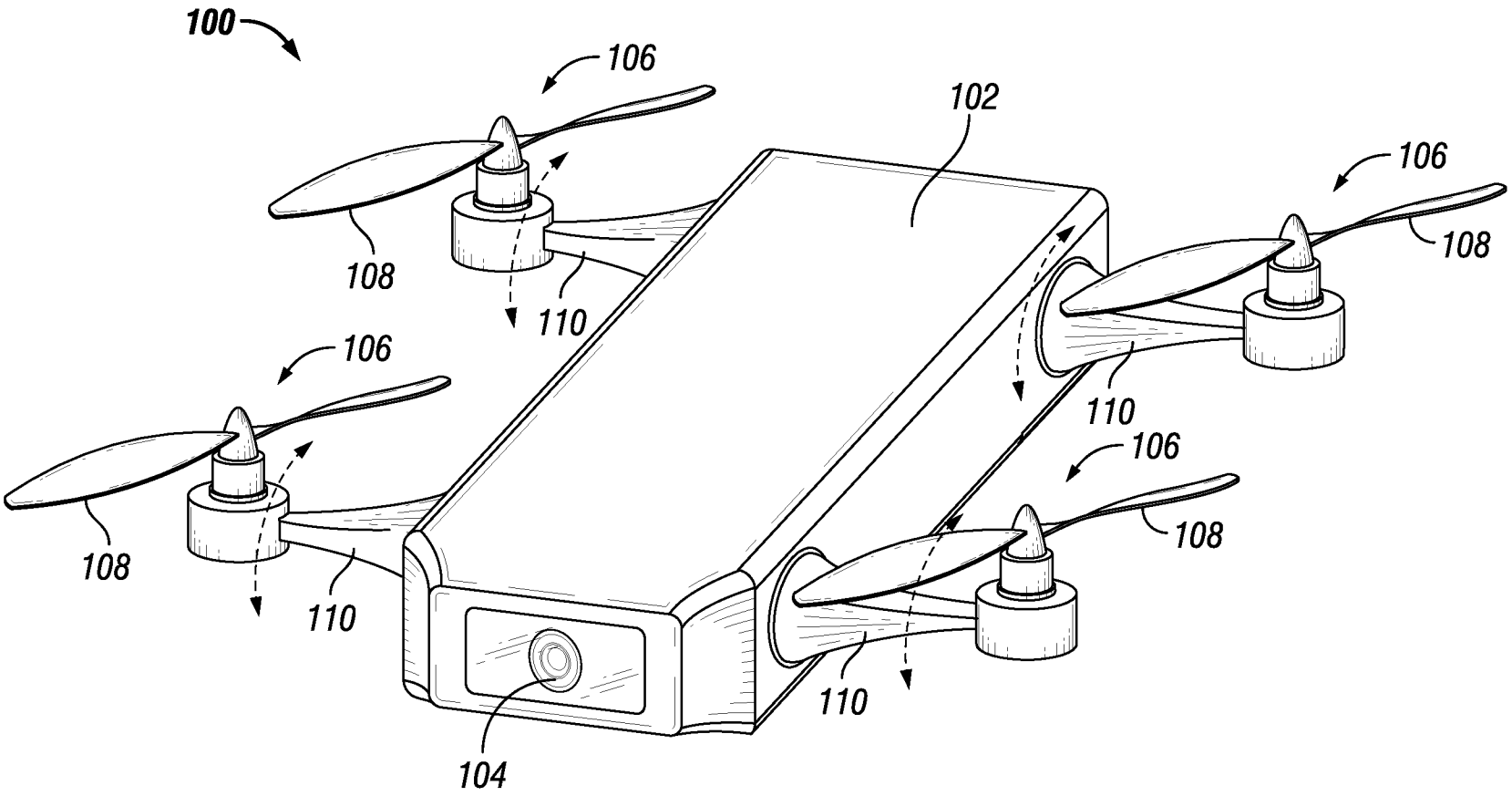
FIG. 1 is a diagram of an unmanned submersible vehicle for surveying a well in accordance with an embodiment of the disclosure.

Embodiments of the disclosure include an unmanned submersible vehicle for use in surveying subsurface wells. The unmanned submersible vehicle may be inserted into a well and may acquire measurements at measurement locations in the well and while traversing the well and at. The unmanned submersible vehicle may include propulsion units having propellers and an arm pivotably attached to a body of the vehicle. The propellers of the propulsion units may be used to measure flow velocity of a fluid when the unmanned submersible vehicle is stationary (that is, while the propulsion units are unpowered). The unmanned submersible vehicle may include a measurement unit for measuring temperature, pressure, and gradient, a control unit, a microcontroller unit, a power unit, and a location unit. The unmanned submersible vehicle may be controlled remotely from the surface via a base station or, in some embodiments, may move autonomously in the well. After acquiring measurements, the unmanned submersible vehicle may exit the well by following fluid flow out of the well FIG. 1 depicts an unmanned submersible vehicle 100 for surveying subsurface wells in accordance with an embodiment of the disclosure. As will be appreciated, for example the unmanned submersible vehicle 100 may include components designed for submergibility in water, oil, gas, and mixtures of having any combinations thereof. Additionally, the unmanned submersible vehicle 100 may include components designed to withstand and operate in downhole conditions (for example, temperature and pressure).

As shown in FIG. 1, the unmanned submersible vehicle 100 may include a body 102, a camera 104, and propulsion units 106. The body 102 may partially or fully enclose multiple components of the unmanned submersible vehicle 100, the details of which are described below. The body 102 may be generally oval-shaped or, in other embodiments, rectangular-shaped. In some embodiments, the body 102 and propulsion units 106 may be sized to enable the unmanned submersible vehicle 100 to enable insertion into and traversal through a wellbore of a well, including vertical, horizontal, and deviated sections of the well. In some embodiments, the unmanned submersible vehicle 100 may have a width of about 2⅜ inches (60.34 millimeters), a length of about 2⅜ inches (60.34 millimeters), and a height of about 2⅜ inches (60.34 millimeters).

In some embodiments, as shown in FIG. 1, the unmanned submersible vehicle 100 may include four propulsion units 106. The propulsion units 106 may propel the unmanned submersible vehicle 100 through a fluid and, as described below, may be used to measure flow velocity of a fluid when the unmanned submersible vehicle 100 is stationary. Each propulsion spinner 106 may include a propeller 108, an electric motor (not shown) coupled to the propeller 108, and an arm 110. The propeller 108 and may be coupled to the main body 102 via the arm 110. The arms 110 may be pivotably attached to the body 102, such that each propulsion unit 106 may be pivoted around an axis to position the respective propeller 108. The arms 110 may be pivotably attached via motorized gimbals or other components that enable rotation of the propulsion units 106.

When the unmanned submersible vehicle is stationary (that is, when the propulsion units 106 are unpowered), the unmanned submersible vehicle 100 may pivot two of the propulsion units into the fluid flow (relying on the horizontal to vertical (H/V) structure of the well), such that the measurement of the flow velocity may be determined according to the rotation of the spinners in the fluid flow according to known techniques (for example, based on the number of turns of the propellers as they rotate in the fluid flow and the cross-sectional area of the contacted area).

In some embodiments, the propulsion units 106 may each include or be coupled to a generator that converts rotation of the propellers 108 into electrical energy. In such embodiments, the rotation of the two propellers used to measure flow velocity may also provide electrical energy to charge a battery of the unmanned submersible vehicle.

The camera 104 may capture still images, video, or both of areas surrounding the unmanned submersible vehicle 100 (for example, the area in front the unmanned submersible vehicle). The camera 104 may be used to provide visual confirmation of a route of the unmanned submersible vehicle 100, visual inspection of a well, and other visual operations. In some embodiments, the camera 104 may capture still images, video, or both. In such embodiments, the camera 104 may be used to provide visual confirmation of a measurement location in a section of a well before the unmanned submersible vehicle acquires measurements.

Figure 2:
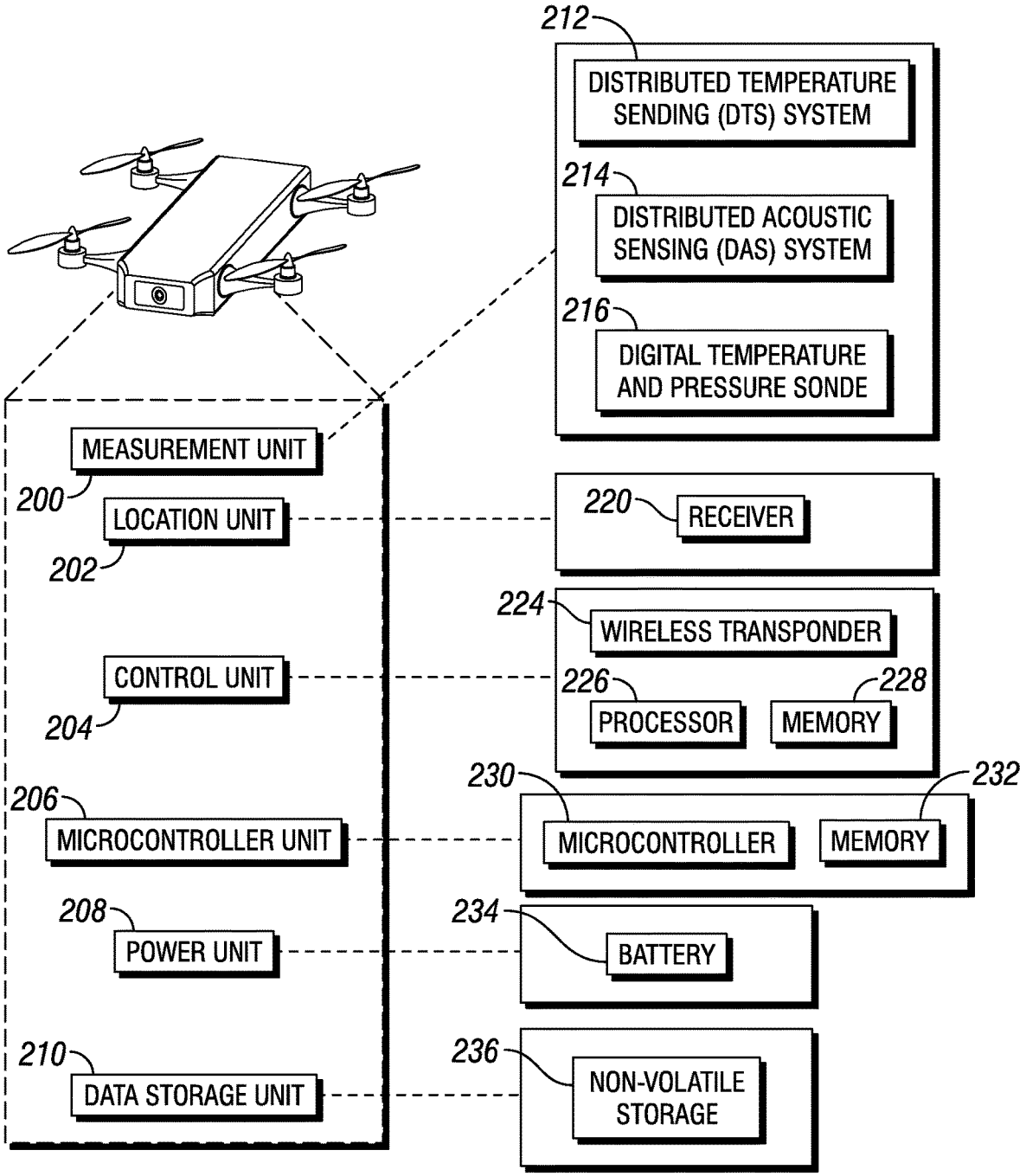
FIG. 2 is a diagram of the components of the unmanned submersible vehicle of FIG. 1 in accordance with an embodiment of the disclosure.

FIG. 2 depicts various components of the unmanned submersible vehicle 100, although it should be appreciated that some components may be omitted for clarity. Other embodiments of the unmanned submersible vehicle 100 may include additional components not illustrated in FIG. 2. As shown in FIG. 2, the unmanned submersible vehicle 100 may include a measurement unit 200, a location unit 202, a control unit 204, a microcontroller unit 206, a power unit 208, and a data storage unit 210.

The measurement unit 200 may include one or more measurement components for measuring temperature, pressure, gradient, and other suitable parameters. In some embodiments, for example, the measurement unit 200 may include a distributed temperature sensing (DTS) system 212, a distributed acoustic sensing (DAS) system 214, a digital temperature and pressure sonde 216. As will be appreciated, the distributed temperature sensing (DTS) system 212 may include components known in the art to enable the measurement of temperature using optical fibers as linear sensors. As will also be appreciated, the distributed acoustic sensing (DAS) system 214 may include components known in the art to enable the measurement of temperature using optical fibers and acoustic frequency signals to measure temperature variations. The digital temperature and pressure sonde 216 may digitally measure temperature and pressure using components known in the art, such as piezoelectric sensors.

The location unit 202 may include a receiver 220 for communication with a satellite-based navigation system, such as the Global Positioning System (GPS), the Globalnaya Navigazionnaya Sputnikovaya Sistema (GLONASS). In some embodiments, the location unit 202 may include, as known in the art, a casing collar locator (CCL), a gamma ray logging tool, or a combination thereof. As will be appreciated, the CCL and gamma ray logging tool may be used to determine a depth in a wellbore. In some embodiments, the location unit 202 may include gyroscope. The location unit 202 may use one or more of these components to determine a location of the unmanned submersible vehicle 100. The location may be used by other units of the unmanned submersible vehicle 100, such as the control unit 204. The location may be transmitted to a computer at the surface for remote control of the unmanned submersible vehicle 100.

As shown in FIG. 2, the control unit 204 may include a wireless transponder 224. The wireless transponder may wirelessly communicate (for example, receive and transmit) with a computer on the surface via suitable wireless communication protocols and technologies to enable remote control of the unmanned submersible vehicle. The wireless transponder may receive remote control commands from a base station at the surface and may transmit data about the unmanned submersible vehicle 100 (such the location of the unmanned submersible vehicle 100) to the base station. In such embodiments, the unmanned submersible vehicle 100 may be remotely controlled from the base station to move the unmanned submersible vehicle 100 through a well. For example, an operator at the base station may view well trajectory data and move the unmanned submersible vehicle 100 to measurement locations in the well. In such embodiments, an operator at the base station may also control the acquisition of measurements by the unmanned submersible vehicle 100, such as by initiating the acquisition of measurements at measurement locations.

As will be appreciated, the control unit may include a processor 226 and associated memory 228. The processor of the control unit may include one or more processors and may include microprocessors, application-specific integrated circuits (ASICs), or any combination thereof. In some embodiments, the processor 226 may include one or more reduced instruction set (RISC) processors, such as those implementing the Advanced RISC Machine (ARM) instruction set. Additionally, the processor 226 may include single-core processors and multicore processors. The memory 228 of the control unit may include which may include one or more non-transitory computer readable storage mediums) may include volatile memory (such as random access memory (RAM)) and non-volatile memory (such as read-only memory (ROM)) accessible by the microcontroller.

In some embodiments, the unmanned submersible vehicle 100 may move autonomously (also referred to as "self-guided") when in a well without requiring commands from a base station. In some embodiments, for example, the unmanned submersible vehicle 100 may use autonomous operation when connectivity to a base station at the surface is lost. In such embodiments, the control unit 204 may include control logic for controlling movement of the unmanned submersible vehicle 100 through a well. In some embodiments, the control unit may include a deviation survey (that is, including the inclination and azimuth) of a well to enable coordinate setting. The control unit 204 may also include a stored route plan that provides a route through a well. For example, the stored route plan may include waypoints (for example, coordinates), well trajectory data, well dimensions, or other data or combinations thereof that enables the unmanned submersible vehicle to autonomously follow a route through a wellbore in a well. Additionally, in some embodiments a stored route plan may include measurement locations (for example, based on coordinates) indicating locations at which the unmanned submersible vehicle 100 may stop movement and acquire measurements. In some embodiments, the control unit 204 may use a location obtained by the location unit 202 during autonomous operation.

In some embodiments, the control unit 204 may monitor a battery of the power unit 208 and determine an amount of battery charge remaining, a remaining operational duration of the unmanned submersible vehicle 100, or both. In such embodiments, the control unit 204 may communicate the amount of battery charge remaining, a remaining operational duration of the unmanned submersible vehicle 100, or both to a base station. In some embodiments, the control unit 204 may communicate an alert when an amount of battery charge remaining is below a threshold amount or the remaining operational duration of the unmanned submersible vehicle 100 is below a threshold amount.

The microcontroller unit 206 may include a microcontroller 230 and associated memory 232. The microcontroller unit 206 may control movement and other functions of the unmanned submersible vehicle 100. The microcontroller 206 of the microcontroller unit may execute various modules stored in the memory 232 of the microcontroller unit and provide commands to the unmanned submersible vehicle 100, such as for movement. The memory 232 of the microcontroller unit (which may include one or more non-transitory computer readable storage mediums) may include volatile memory (such as random access memory (RAM)) and non-volatile memory (such as read-only memory (ROM)) accessible by the microcontroller. For example, the memory 232 of the microcontroller unit may store executable computer code for providing functions of the unmanned submersible vehicle 100.

The power unit 208 may include a battery 234. In some embodiments, for powering the unmanned submersible vehicle 100 and the components of the vehicle 100, such as a battery located in the body of the unmanned submersible vehicle 100 for powering the operating and flight of the unmanned submersible vehicle 100. In some embodiments, the power unit 208 may include multiple batteries. In such embodiments, power unit 208 may include a separate battery for powering other units of the unmanned submersible vehicle 100, such for powering the measurement unit 200. In some embodiments, a battery in the power unit 208 may be rechargeable. For example, as discussed herein the battery may be rechargeable using electricity converted from the mechanical rotation of the propellers of the units 106. In some embodiments, the battery may include a nickel-based battery (for example, nickel cadmium or nickel metal hydride), a lithium-based battery (lithium ion, lithium polymer, etc.), or other suitable batteries.

The data storage unit 210 may include a non-volatile storage medium 236. For example, in some embodiments, the non-volatile storage medium may be solid state memory. The data storage unit 210 may be accessible by other units of the unmanned submersible vehicle 100, such as the measurement unit 200 and the control unit 204. For example, the data storage unit 210 may store measurements acquired by the measurement unit 200. In such embodiments, the data storage unit 210 may store measurements until the unmanned submersible vehicle is retrieved at the surface. At the surface, measurements may be copied from the one or more non-volatile storage mediums of the data storage unit 210 to a computer via, for example, a wired connection between the computer and the unmanned submersible vehicle 100 or removal of the data storage unit 210 for connection or insertion in a computer.

Figure 3:
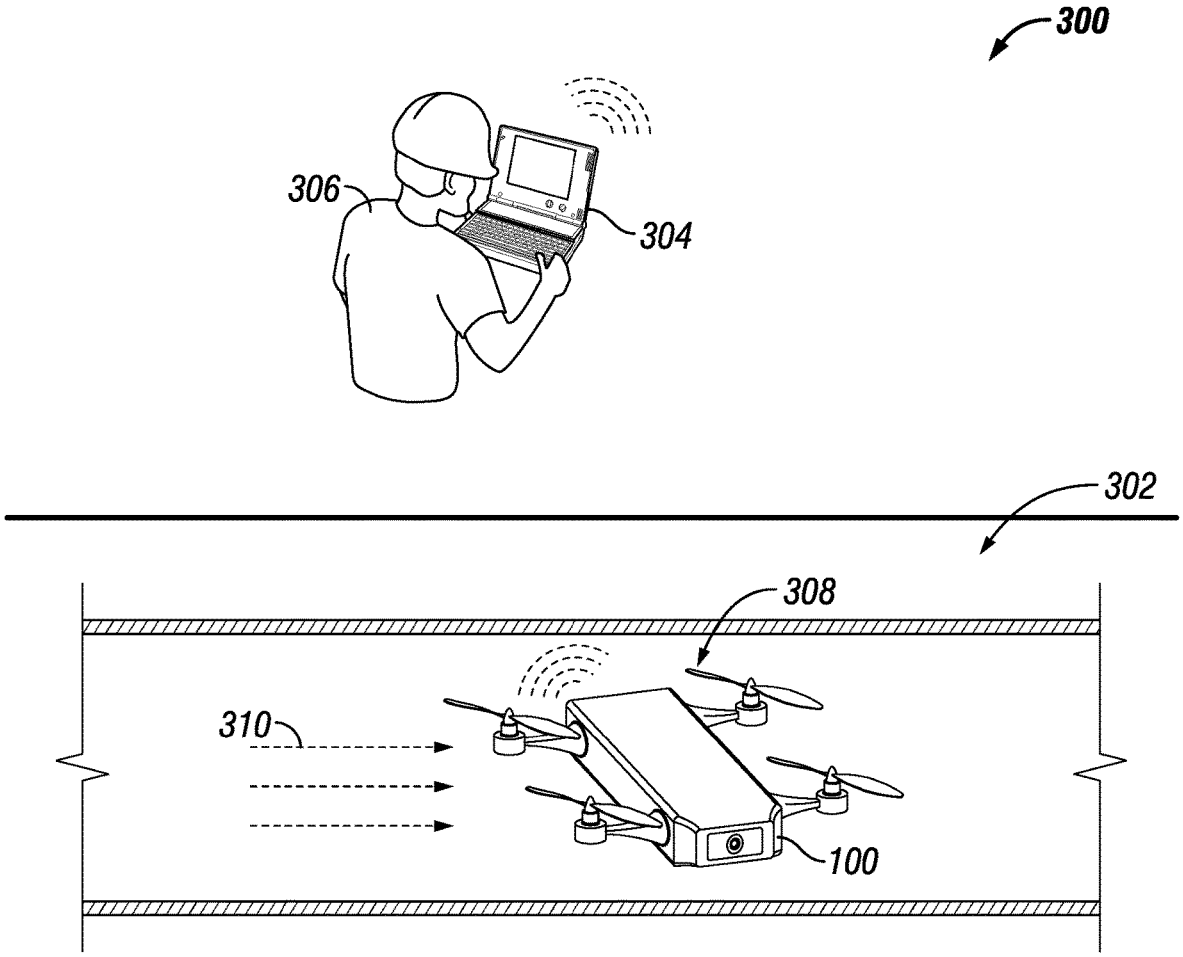
FIG. 3 is diagram of the operation of an unmanned submersible vehicle for surveying a well in accordance with an embodiment of the disclosure.

FIG. 3 depicts an environment 300 illustrating operation of the unmanned submersible vehicle 100 engaged in measurement of fluids in a section 302 of a subterranean well in accordance with an embodiment of the disclosure. The well section 302 may be in a section of a production well that, in some embodiments, may be difficult, costly, and time-consuming to reach via prior methods of coiled tubing or other techniques. The section 302 may represent a horizontal section of a well. As will be appreciated, other sections of a well may be measured by the unmanned submersible vehicle 100, including vertical sections of a well, deviated sections of a well, and so on. The section 302 may be a cased hole or open hole section of a well. In some embodiments, the unmanned submersible vehicle 100 may move between cased and open hole sections of a well when surveying a well.

In some embodiments, the unmanned submersible vehicle 100 may be associated with and, in some embodiments, may communicate with, a base station 304. In some embodiments, an operator 306 may communicate with the unmanned submersible vehicle 100 via the base station 304. In some embodiments, the unmanned submersible vehicle 100 may be remotely piloted by the operator 306 via the base station 304. For example, the operator 306 may monitor the location of the unmanned submersible vehicle 100, as determined by the location unit 202, and remotely control the unmanned submersible vehicle 100 to measurement locations in the well.

In other embodiments, the unmanned submersible vehicle 100 may engage in autonomous operation. In some embodiments, the autonomous operation may be based on routes, locations, or a combination thereof stored by the unmanned submersible vehicle 100. In such embodiments, for example, the unmanned submersible vehicle 100 may use the location unit 202 to provide data for autonomous operation. For example, the unmanned submersible vehicle 100 may use one or more measurement locations (for example, based on coordinates) as waypoints on a route to autonomously traverse a well.

As shown in FIG. 3, the unmanned submersible vehicle 100 may traverse the well to a measurement location 308 located in the well section 302. Advantageously, the unmanned submersible vehicle does not contact the borehole wall to move through the well. During traverse of the well, the measurement unit 200 may be used to continuously or periodically acquire temperature measurements, pressure measurements, or any combination thereof while traversing the well to the measurement location 308. As will be appreciated, the measurement location 308 may be determined from logs from previously performed logging operations, as well segmentation of production on an equal basis based on log stops.

Upon reaching the measurement location 308, the unmanned submersible vehicle 100 may stop moving and remain stationary (that is, without using the propulsion units 106) for a time period to acquire measurements of a fluid (the flow of which is depicted by arrows 310) in the well section 302. The fluid may be, for example, water, oil, gas, or any combination thereof. At the measurement location 308, the unmanned submersible vehicle 100 may measure the flow velocity of the fluid 310 using two of the propulsion units. The unmanned submersible vehicle 100 may pivot two of the propulsion units into the fluid flow (relying on the horizontal to vertical (WV) structure of the well), such that the measurement of the flow velocity may be determined according to the rotation of the propellers in the fluid flow according to known techniques. Additionally, the rotation of the two propellers used to measure flow velocity may, in some embodiments, provide electrical energy to charge a battery of the power unit 208 via a generator coupled to each propeller. The unmanned submersible vehicle 100 may acquire additional measurements at the measurement location 308. For example, the measurement unit 200 may be used to acquire temperature measurements, pressure measurements, gradient measurements, or any combination thereof, in addition to those measurement continuously or periodically acquired during traversal of the well to the measurement location 308.

After acquisition of measurements at the measurement location 308, the unmanned submersible vehicle may proceed to another measurement location or exit the well. For example, additional measurement locations exist, the unmanned submersible vehicle may be remotely or autonomously moved to the next measurement location. If no other measurement locations exist, the unmanned submersible vehicle 100 may exit the well. In such instances, the unmanned submersible vehicle may be remotely or autonomously moved to a section of the well that enables exiting of the well via the flow out of the well. In some embodiments, the unmanned submersible vehicle may use the propulsion units 106 to assist in exiting the well (for example, if the fluid flow is insufficient to move the unmanned submersible vehicle 100 out of the well).

Figure 4:
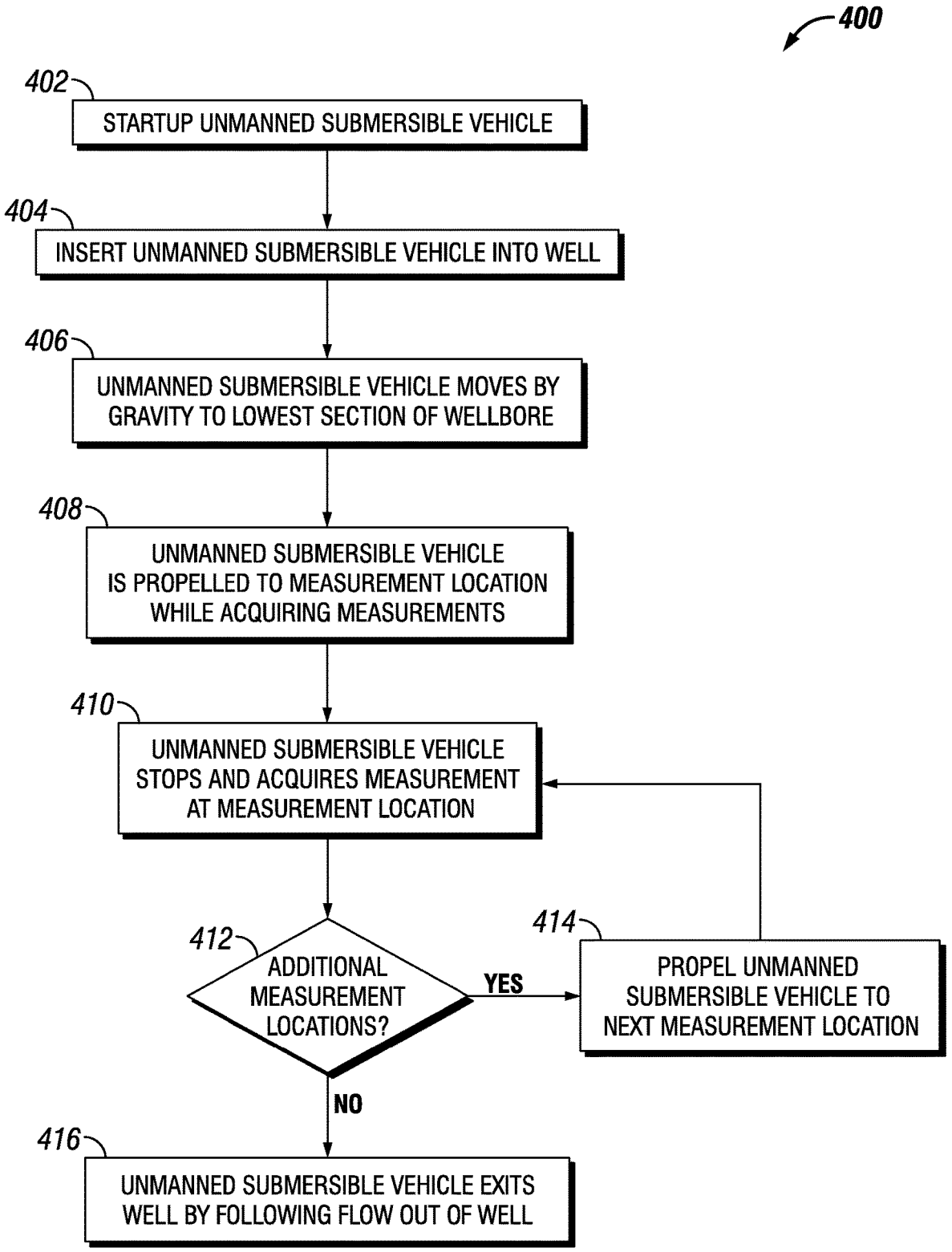
FIG. 4 is a block diagram of a process for surveying a well using an unmanned submersible vehicle in accordance with an embodiment of the disclosure.

FIG. 4 is a block diagram of a process 400 for surveying a well using the unmanned submersible vehicle described herein in accordance with an embodiment of the disclosure. Initially, an unmanned submersible vehicle may undergo a startup sequence (block 402). For example, the startup may include powering on the unmanned submersible vehicle, initializing electronic components of the unmanned submersible vehicle, etc. For example, electric components such as the measurement unit, location unit, camera, and so on may be initialized to ensure proper operation.

Next the unmanned submersible vehicle may be inserted into a well (block 404). In some embodiments, the well may be shut-in during insertion of the unmanned submersible vehicle. The well may then remain shut-in during surveying by the unmanned submersible vehicle or may be in production. After insertion into the well, the unmanned submersible vehicle may move via gravity to the lowest section of the wellbore (block 406). For example, the location unit, the measurement unit, or both may be used to determine when the unmanned submersible vehicle is located at the lowest section of the well.

After reaching the lowest section of the well, the unmanned submersible vehicle traverse the well to a measurement location while acquiring measurements (block 408). For example, the unmanned submersible vehicle may continuously or periodically acquire temperature, pressure, and gradient measurements while moving through a well. The measurement location may be in a production section of the well, such that the unmanned submersible vehicle moves from the initial location in a well to a production section.

After reaching the measurement location, the unmanned submersible vehicle may stop propulsion (that is, by ceasing powering of the propulsion units) and acquire measurements at the measurement location (block 410). For example, as discussed in the disclosure, the unmanned submersible vehicle may measure the flow velocity of a fluid at the measurement location using the propellers of the propulsion units. Additionally, the unmanned submersible vehicle may acquire temperature measurements, pressure measurements, and gradient measurements at the measurement location. As also described in the disclosure, the unmanned submersible vehicle may recharge a battery in the power unit using the rotation of the propellers by the fluid. In such embodiments, the unmanned submersible vehicle may stop moving for a time period. The time period may be a time period sufficient to acquire one or more flow velocity measurements or recharge a battery to a specific charge level. For example, after stopping the unmanned submersible vehicle may not resume propulsion until the one or more flow velocity measurements are acquired other battery is recharged to a specific charge level (for example, a percentage of battery capacity). After acquiring flow velocity measurement, the propulsion units using for measuring flow velocity may be pivoted back to a position suitable for propulsion of the unmanned submersible vehicle.

After acquiring measurements, additional measurement locations may be determined (decision block 412). For example, in some embodiments, the unmanned submersible vehicle may store a list of measurement locations in one or more sections of a well to enable determination of additional measurement locations. Such measurement locations may be designated on a route or map of the well stored by the unmanned submersible vehicle. Additionally, or alternatively, an operator remotely controlling the unmanned submersible vehicle may have access to a list of measurement locations in one or more sections of a well and may use the list to determine additional measurement locations.

If additional measurement locations are determined, the unmanned submersible vehicle may traverse the well to the next measurement location (block 414). In some embodiments, for example, the unmanned submersible vehicle may move to additional measurement locations in a section of the well or move to different section of the well to acquire additional measurements. Here again, the unmanned submersible vehicle may continuously or periodically acquire temperature, pressure, and gradient measurements while traversing the well to the next measurement location. After reaching the next measurement location the unmanned submersible vehicle may stop and acquire measurements (block 410), as described herein, and continue until no additional measurement locations are determined (decision block 412).

If no additional measurement locations are determined (decision block 412), the unmanned submersible vehicle may exit the well by following fluid flow out of the well (block 416). For example, in some embodiments, the unmanned submersible vehicle may be remotely or autonomously moved to a section of the well that enables exiting of the well. For example, the unmanned submersible vehicle may move to a wellbore that opens to the surface. In some embodiments, the unmanned submersible vehicle may use the propulsion units to assist in exiting the well (for example, if the fluid flow is insufficient to enable the unmanned submersible vehicle to exit the well).

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used in the disclosure are for organizational purposes only and are not meant to be used to limit the scope of the description.

What is claimed is:

1. An unmanned submersible vehicle for surveying a well, comprising:

a body;

a plurality of propulsion units, each of the plurality of propulsion units comprising a propeller and an arm pivotably coupled to the body;

a measurement unit; and a control unit comprising a processor and a memory;

wherein the each of the plurality of propulsion units is configured to measure a flow velocity of a fluid in the well when the unmanned submersible vehicle is stationary.

2. The unmanned submersible vehicle of claim 1, wherein the measurement unit comprises a distributed temperature sensing (DTS) system.

3. The unmanned submersible vehicle of claim 1, wherein the measurement unit comprises a distributed acoustic sensing (DAS) system.

4. The unmanned submersible vehicle of claim 1, wherein the measurement unit comprises a digital temperature sonde, a digital pressure sonde, or a combination thereof.

5. The unmanned submersible vehicle of claim 1, comprising a location unit, the location unit comprising a receiver for a satellite-based navigation system.

6. The unmanned submersible vehicle of claim 1, comprising a power unit comprising a rechargeable battery.

7. The unmanned submersible vehicle of claim 6, wherein at least one of the plurality of propulsion units is coupled to a generator, wherein the generator converts rotation of a respective propeller into electrical energy to recharge the rechargeable battery.

8. The unmanned submersible vehicle of claim 1, comprising a data storage unit comprising a non-volatile memory.

9. The unmanned submersible vehicle of claim 1, comprising a microcontroller unit, the microcontroller unit comprising a microcontroller and a memory.

10. The unmanned submersible vehicle of claim 1, comprising a camera coupled to the body.

11. A method of surveying a well, comprising:

positioning an unmanned submersible vehicle at a measurement location in the well, the unmanned submersible vehicle comprising:

a plurality of propulsion units, each of the plurality of propulsion units comprising a propeller and an arm pivotably coupled to the body;

a measurement unit; and a control unit comprising a processor and a memory;

measuring, at the measurement location, a flow velocity of a fluid flowing in the well using at least two of the propulsion units.

12. The method of claim 11, comprising measuring, at the measurement location, a temperature and a pressure in the well.

13. The method of claim 11, wherein the measurement location is a first measurement location, the method comprising:

moving the unmanned submersible vehicle to second measurement location.

14. The method of claim 13, comprising measuring, during the moving, a temperature and a pressure in the well.

15. The method of claim 13, comprising measuring, at the second measurement location, a flow velocity of a fluid flowing in the well using at least two of the propulsion units.

16. The method of claim 11, wherein the unmanned submersible vehicle comprises a power unit comprising a rechargeable battery.

17. The method of claim 16, comprising charging the rechargeable battery by converting rotation of a respective propeller of one of the plurality of propulsion units into electrical energy.

18. The method of claim 11, wherein measuring, at the measurement location, a flow velocity of a fluid flowing in the well using at least two of the propulsion units comprising pivoting the at least two of the propulsion units such that the respective propellers of the at least two propulsion units rotate in response to the flow of the fluid.

19. The method of claim 11, wherein the unmanned submersible vehicle comprises a data storage unit comprising a non-volatile memory.

20. The method of claim 19, comprising storing the flow velocity measurement in the non-volatile memory.

21. A method of surveying a well, comprising:

inserting an unmanned submersible vehicle into a wellbore of the well, the unmanned submersible vehicle comprising:

a plurality of propulsion units, each of the plurality of propulsion units comprising a propeller and an arm pivotably coupled to the body;

moving the unmanned submersible vehicle to a measurement location in the well; and measuring, at the measurement location, a flow velocity of a fluid flowing in the well using at least two of the propulsion units.

22. The method of claim 21, wherein the measurement location is at a production section of the well.

23. The method of claim 21, wherein measuring, at the measurement location, a flow velocity of a fluid flowing in the well using at least two of the propulsion units comprising pivoting the at least two of the propulsion units such that the respective propellers of the at least two propulsion units rotate in response to the flow of the fluid.

* * * * *